US010435900B2

(12) United States Patent
Gladue

(10) Patent No.: US 10,435,900 B2
(45) Date of Patent: Oct. 8, 2019

(54) SWIMMING POOL SKIMMER BASKET HANDLE

(71) Applicant: Three Bee Solutions, LLC, Middleboro, MA (US)

(72) Inventor: William J. Gladue, Middleboro, MA (US)

(73) Assignee: Three Bee Solutions LLC, Middleboro, MA (US)

( * ) Notice: Subject to any disclaimer, the term of this patent is extended or adjusted under 35 U.S.C. 154(b) by 0 days.

(21) Appl. No.: 16/145,293

(22) Filed: Sep. 28, 2018

(65) Prior Publication Data

US 2019/0032352 A1 Jan. 31, 2019

Related U.S. Application Data

(63) Continuation-in-part of application No. 15/906,351, filed on Feb. 27, 2018, now Pat. No. 10,105,833.

(60) Provisional application No. 62/465,921, filed on Mar. 2, 2017.

(51) Int. Cl.

| | |
|---|---|
| ***B25G 1/10*** | (2006.01) |
| ***E04H 4/12*** | (2006.01) |
| ***E04H 4/14*** | (2006.01) |

(52) U.S. Cl.

CPC ..... *E04H 4/1272* (2013.01); *E04H 4/14* (2013.01)

(58) Field of Classification Search

CPC ... Y19T 16/476; Y19T 16/469; Y19T 16/473; Y19T 16/901; B25G 1/10; B25G 1/102; B25G 1/04; B25G 1/06; B25G 3/00; B25G 3/02; B25G 3/04; A01B 1/22; A01B 1/227; A01B 1/022; A47L 13/022; E04H 4/1272; E04H 4/12; E04H 4/1218; E04H 4/1263; B65G 7/00; B65G 7/02; B65G 7/12

See application file for complete search history.

(56) References Cited

U.S. PATENT DOCUMENTS

| | | | |
|---|---|---|---|
| 2,029,185 | A | 1/1936 | Panoff |
| 3,469,700 | A | 9/1969 | Johnson |
| 4,802,391 | A | 2/1989 | Willhoite et al. |
| 4,982,987 | A | 1/1991 | Riggins |
| 5,124,032 | A | 6/1992 | Newhard |
| D377,249 | S | 1/1997 | Granshaw |
| 5,830,350 | A | 11/1998 | Voss et al. |
| 5,888,386 | A | 3/1999 | Enright et al. |

(Continued)

OTHER PUBLICATIONS

The Skimmer Angel Basket Handle, GABCo Products, Inc., Jan. 18, 2008.

*Primary Examiner* — Chuck Y Mah
(74) *Attorney, Agent, or Firm* — Altman & Martin; Steven K Martin

(57) ABSTRACT

A skimmer basket handle with a horizontal crossbar, a post that extends upwardly from the crossbar to a grip, and a leg that extends downwardly from the crossbar to a foot. The crossbar extends the diameter of the basket. Horizontal knobs at each end of the crossbar fit into openings in the sides of the basket. The post maintains the grip above the water line. The leg and foot are sized and shaped so that the bottom of the foot rests on the floor of the basket when installed to maintain the handle in the upright position. To make the length adjustable for baskets of different depths, the leg is relatively short with a number of spaced annular grooves and the foot has a tubular upward extension with an internal annular ridge. The leg is pushed into the extension until the ridge snaps into the desired groove.

17 Claims, 11 Drawing Sheets

(56) References Cited

U.S. PATENT DOCUMENTS

| | | | |
|---|---|---|---|
| 5,899,514 | A | 5/1999 | York |
| 6,180,017 | B1 | 1/2001 | Usher |
| 6,386,608 | B1 | 5/2002 | Eister |
| 6,422,623 | B1 | 7/2002 | Thomas |
| 6,471,856 | B1 | 10/2002 | Keith |
| 6,592,756 | B1 | 7/2003 | Felix, Jr. et al. |
| D509,034 | S | 8/2005 | Morelock |
| 7,032,252 | B2 | 4/2006 | Mercado |
| 7,108,304 | B2 | 9/2006 | White |
| 8,042,849 | B2 | 10/2011 | Pratt |
| 8,091,934 | B2 | 1/2012 | Bair |
| 8,168,065 | B1 | 5/2012 | Gavigan et al. |
| 9,016,738 | B2 | 4/2015 | Smith |
| 9,260,877 | B2 | 2/2016 | Lopez |
| 9,387,583 | B1 | 7/2016 | Coan |
| 9,809,989 | B2 | 11/2017 | Blanc Tailleur et al. |
| 9,896,855 | B2 | 2/2018 | Angelino |
| 2004/0045895 | A1 | 3/2004 | Bonelli et al. |
| 2014/0327257 | A1 | 11/2014 | Vasquez |

SWIMMING POOL SKIMMER BASKET HANDLE

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to swimming pools, more particularly, to an extended handle for a pool skimmer basket.

2. Description of the Related Art

Most swimming pools have a skimmer that filters large debris, such as leaves and insects, from the water. The water enters a skimmer well through an aperture and weir in the pool wall at the water line. A porous skimmer basket sits in the well to trap the debris. The pool water passes through the basket into the pipe that carries the water to the filter. Because the basket fills up with debris over time, it is generally removable for emptying and cleaning.

When the basket needs to be emptied, it is pulled from the well. The debris can be pulled out of the basket by hand. However, because the debris can be hazardous—it may have insects and other dead animals that fell into the pool—many people prefer to dump the debris out without touching it.

Most baskets are equipped with a handle that allows for removal of the basket from the skimmer. In order to access the handle, the user must place their hand in the water, exposing them to the possibility of contact with snakes, live or dead animals, bees, insects, etc.

BRIEF SUMMARY OF THE INVENTION

The present invention is handle that can be installed in most any existing skimmer basket. The handle has a crossbar, a post that extends upwardly from the crossbar to a grip, and a leg that extends downwardly from the crossbar to a foot.

The crossbar extends horizontally the diameter of the basket. Each end of the crossbar has a mechanism for attaching the crossbar to the basket, preferably a knob that extends horizontally from the end of the crossbar that fits into an opening that already exists in the side of the basket.

The post is long enough to maintain the grip above the water line. The grip can be any shape that may be grasped by a person to lift the skimmer basket from the well.

The leg and foot are sized so that the bottom of the foot rests on the floor of the basket when the handle is properly installed. The foot is shaped to maintain the handle in the upright position by extending horizontally to the leg and perpendicularly to the crossbar.

Different skimmer baskets have different depths. The leg is made relatively short with several annular grooves. The foot has a tubular upward extension with an annular ridge.

The leg is pushed into the extension until the ridge is within the desired groove for the basket depth.

To install the handle, one knob is inserted into one basket opening, the basket is slightly deformed to elongate the distance between the opposed openings, the other knob is aligned with the opposite opening, and the basket is allowed to return to its normal shape with the knobs installed in the openings and the foot resting on the basket floor.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporates by reference in its entirety U.S. patent application Ser. No. 15/906,351, on which this application is based.

Figure 1:
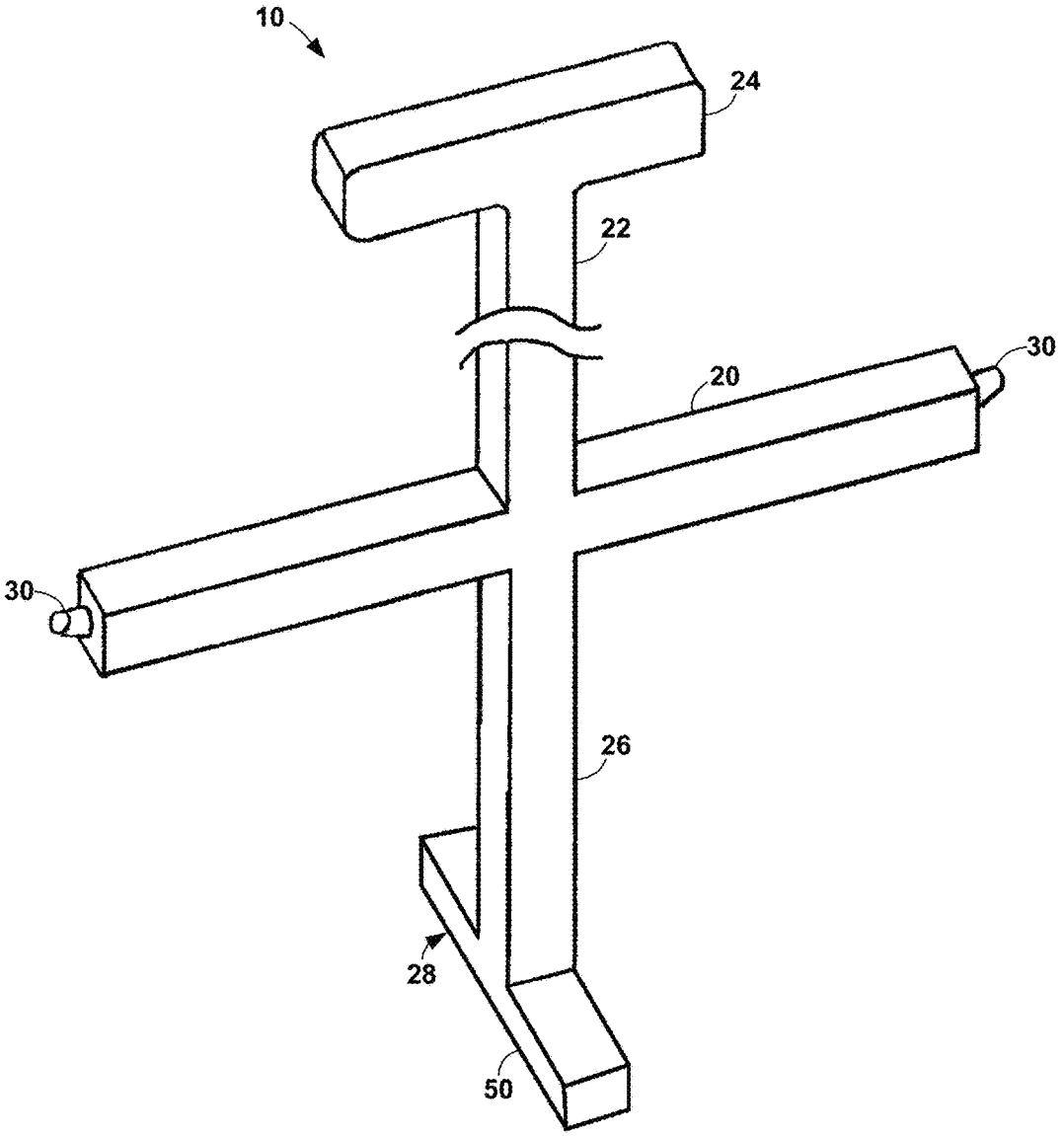
FIG. 1 is a perspective view of a bar configuration of the handle of the present invention.

The present invention is a handle 10 that can be installed in most any existing skimmer basket 2. As shown in FIG. 1, the handle 10 includes a crossbar 20, an upwardly-extending post 22 that ends at a grip 24, and a downwardly-extending leg 26 that ends in a foot 28.

The crossbar 20 extends horizontally the diameter of the basket 2. The cross-sectional size and shape of the crossbar 20 is not important, only that it is robust enough that it does not break under normal use. Different skimmer baskets have different diameters. The present invention contemplates manufacturing handles with crossbars of different lengths to accommodate different basket diameters.

Each end of the crossbar 20 has a mechanism for attaching the crossbar 20 to the basket 2. In the preferred configuration, a knob 30 extends horizontally from the end of the crossbar 20. The knobs 30 are designed to fit into openings 6 that already exist in the side of the basket 2.

The present invention contemplates that the knobs 30 can have any shape that will fit into openings 6 in the side of the basket 2. For example, the baskets 2 are made as a gross mesh that is formed by a multitude of crossing ribs. The shape of the openings 6 between the ribs depends on the orientation of the ribs relative to each other and can be squares, rectangles, circles, triangles, etc. Many baskets 2 have a pair of opposed round openings 6 adjacent to the top edge.

Figure 11:
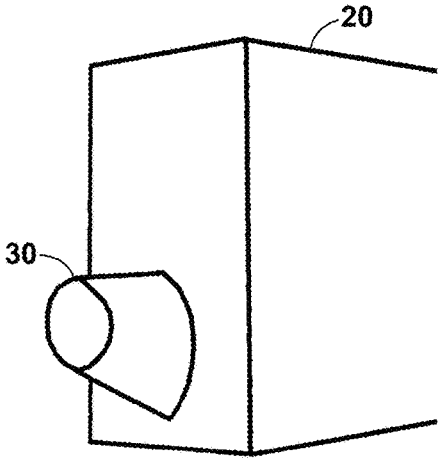
FIG. 11 is a detailed view of a knob.
Figure 12:
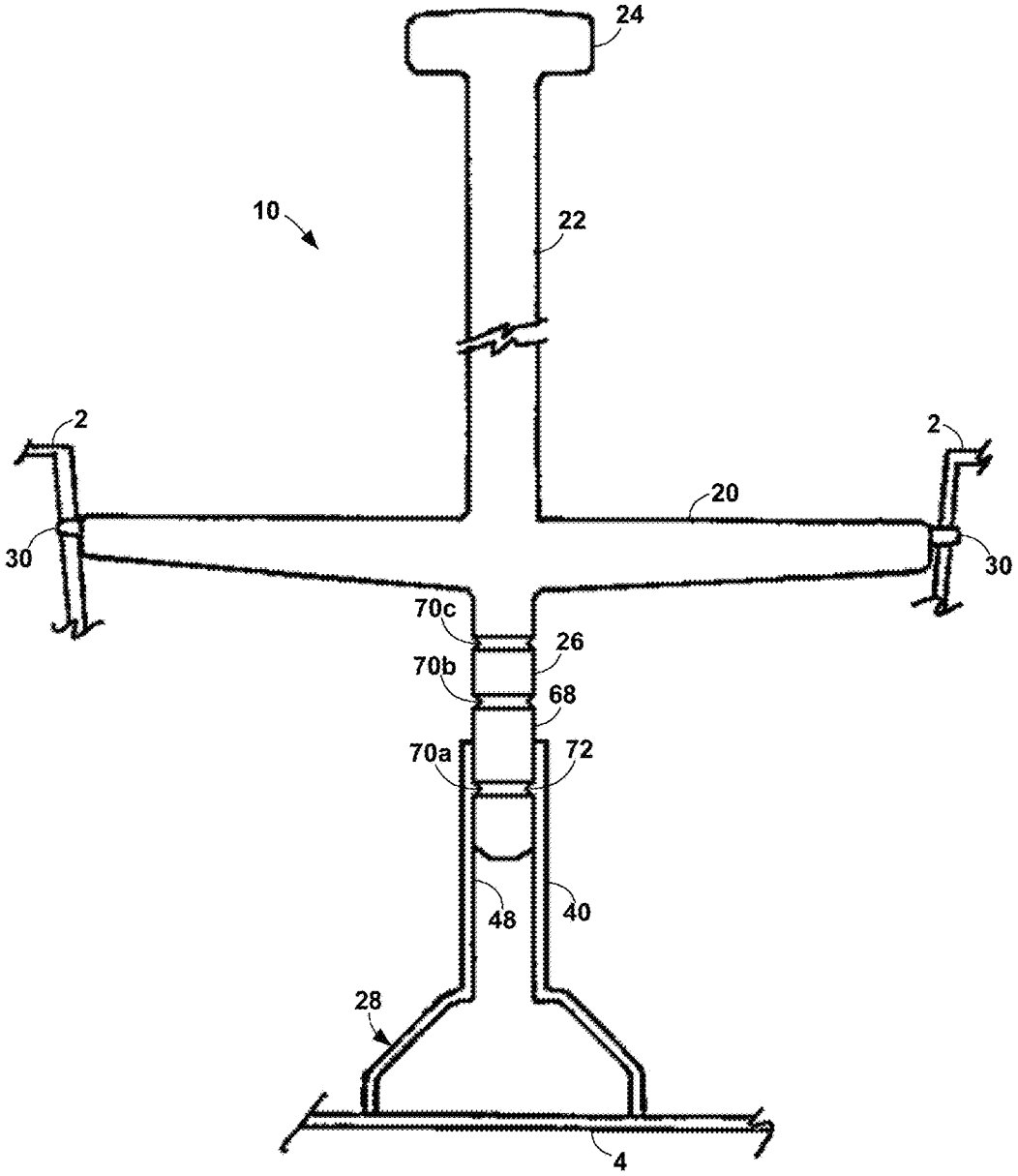
FIG. 12 is a partial cross-sectional, side view of another configuration.

The knobs 30 can be shaped to fit into opposed mesh openings or the opposed round openings 6. The preferred knobs 30 are cylindrical or tapered and either round, oval, or egg-shaped in cross-section to fit into openings 6 or different shapes. A tapered, oval cross-section knob 30 is shown in FIG. 11.

The post 22 extends upwardly from the crossbar 20 to a grip 24. The post 22 is long enough to maintain the grip 24 above the water line. Typically, the post 22 will be short enough that the grip 24 does not interfere with the skimmer well cover. The grip 24 can be any shape that may be grasped by a person to lift the skimmer basket from the well. Possible shapes include a tee, as in the figures, a sphere, an ellipsoid, a disk, a circle, or an oval.

Figure 4:
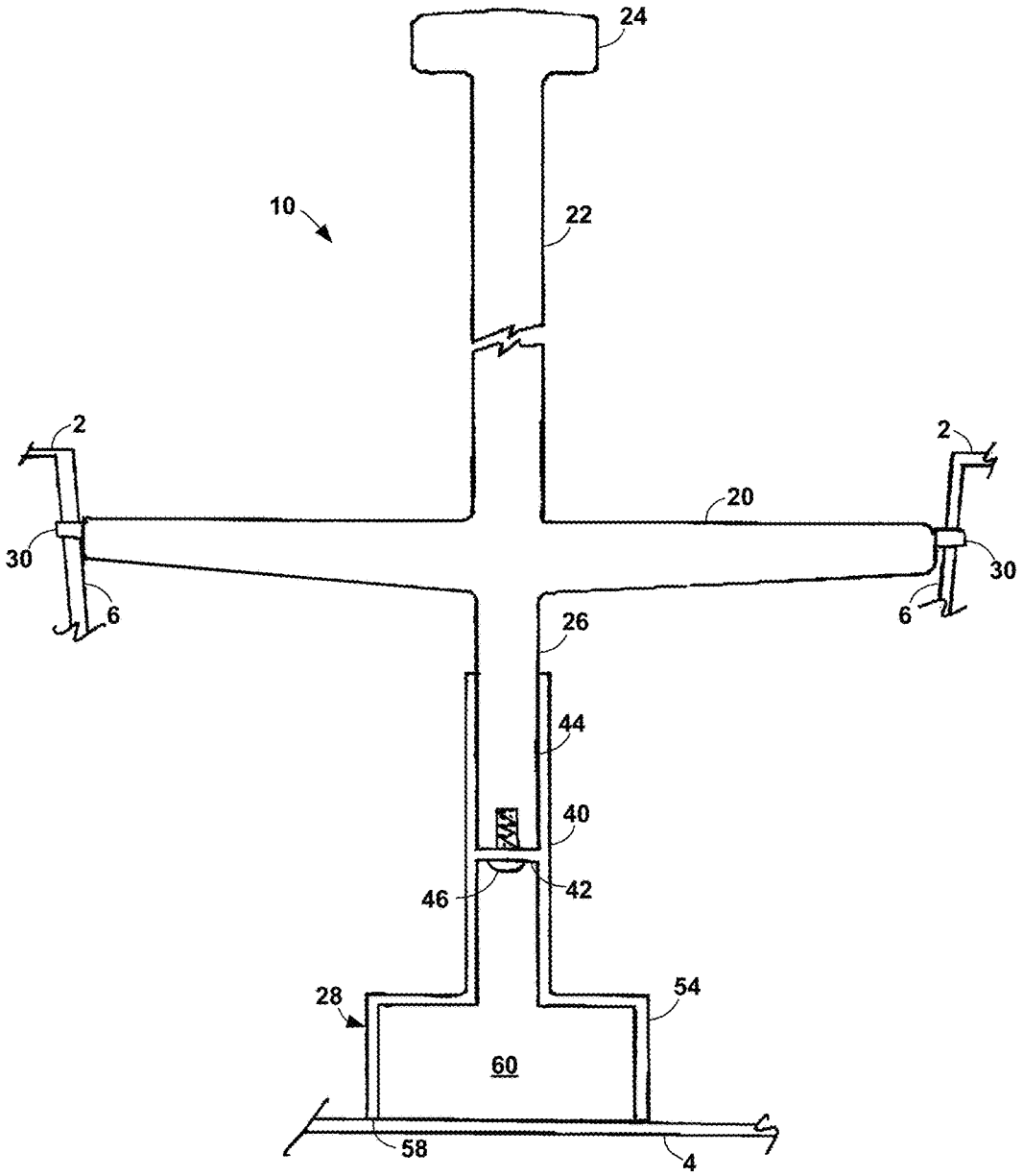
FIG. 4 is a side, cross-sectional view of a configuration of the handle with an inverted cup foot.
Figure 5:
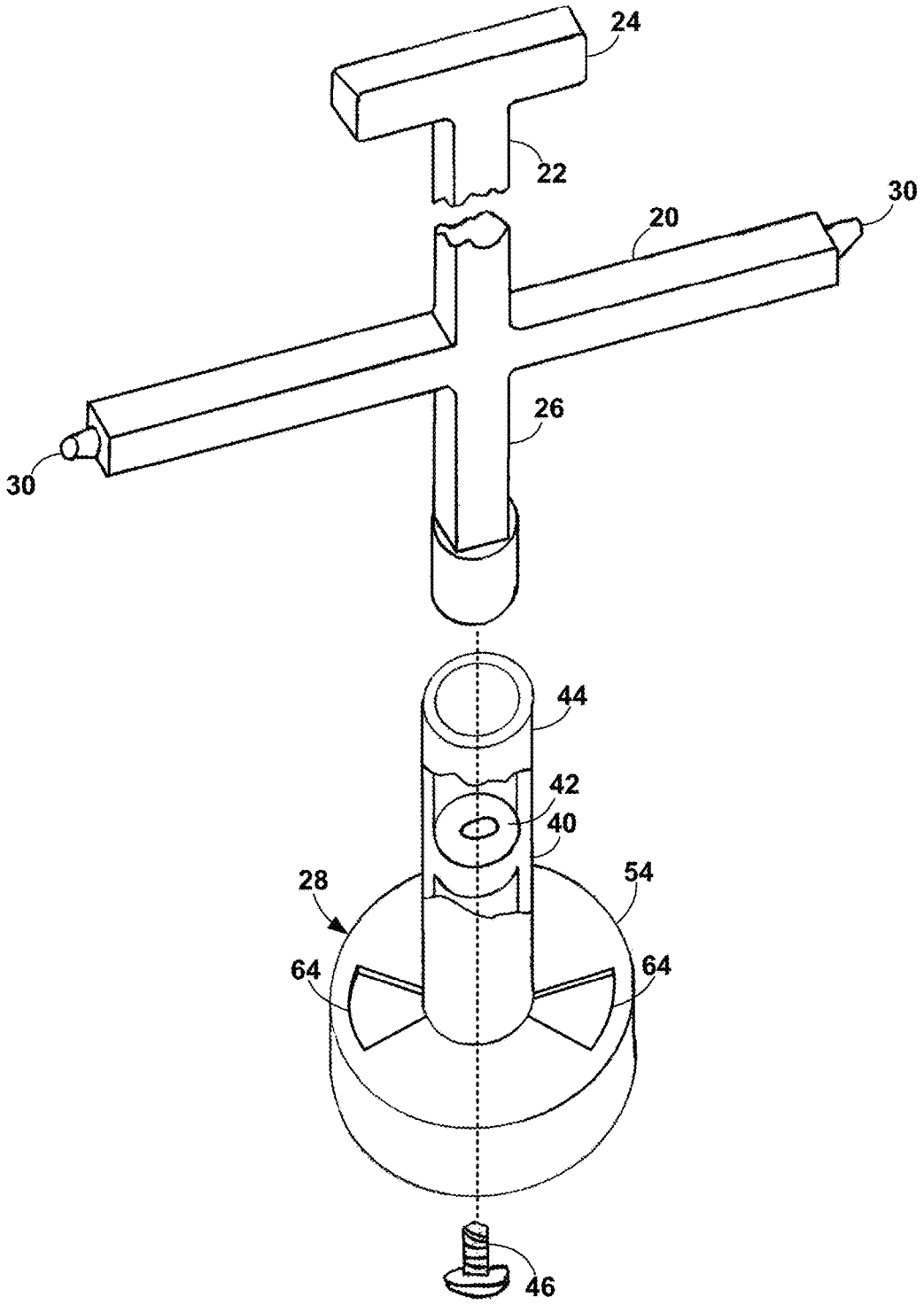
FIG. 5 is an exploded, partial cross-sectional view of the configuration of FIG. 4.
Figure 6:
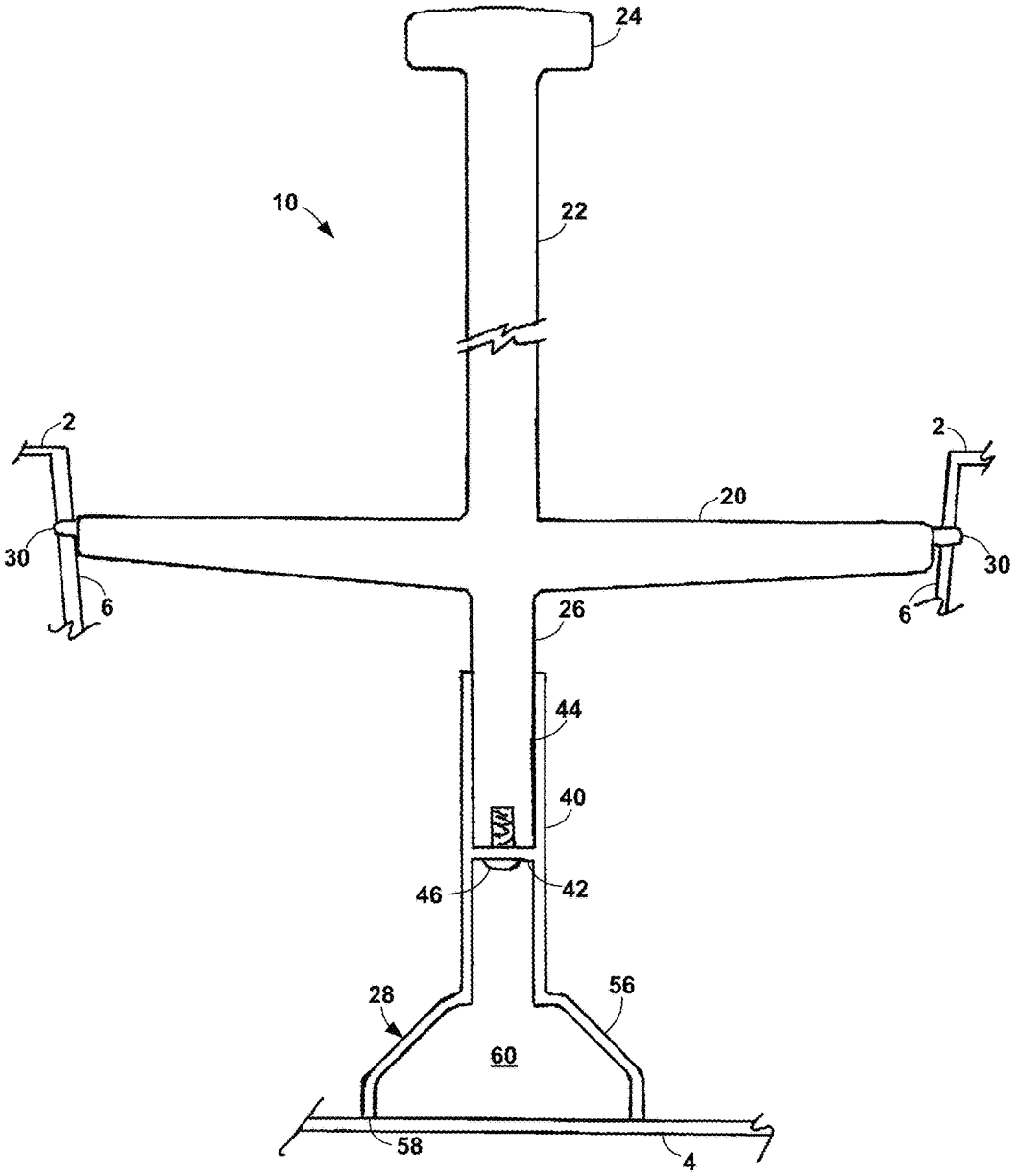
FIG. 6 is a side, cross-sectional view of a configuration of the handle with an inverted cone foot.
Figure 7:
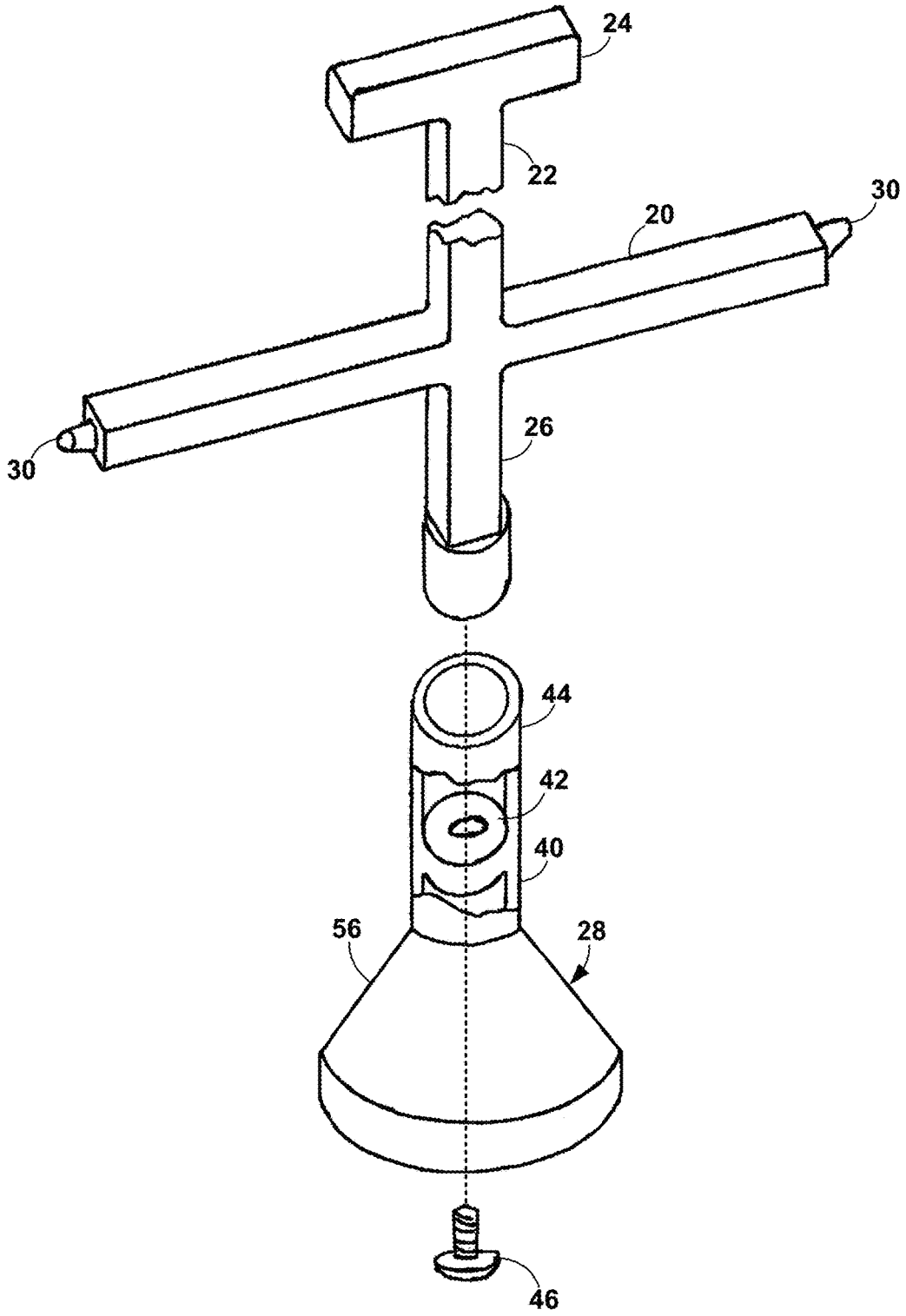
FIG. 7 is an exploded, partial cross-sectional view of the configuration of FIG. 6.

The leg 26 extends downwardly from the crossbar 20. At the end of the leg 26 is a foot 28. The leg 26 and foot 28 are sized so that the bottom 32 of the foot 28 rests on the floor 4 of the basket 2 when the handle 10 is properly installed in order to maintain the handle 10 in the upright position. To facilitate this function, the foot 28 is shaped to prevent the handle 10 from swinging when installed in the basket openings 6. The foot 28 extends horizontally at least perpendicularly to the leg 26 and the crossbar 20, as in FIG. 1. An non-exhaustive list of foot shapes includes a bar 50 as in FIG. 1, a disk 52 as in FIGS. 2 and 3, an inverted cup 54 as in FIGS. 4 and 5, and an inverted cone 56 as in FIGS. 6 and 7. The inverted cup 54 and inverted cone 56 have a lip 58 that contacts the basket floor 4 and a hollow interior 60. The hollow interior 60 prevent any protrusions extending from the center of the basket floor 4, such as molding artifacts, from interfering with the foot 28. For the same reason, the underside of the bar 50 or disk 52 can have a depression in the center. Optionally, the top surface 62 of a hollow foot 28 can have vent openings 64, as in FIG. 5, to facilitate water flow through the basket during use.

Figure 2:
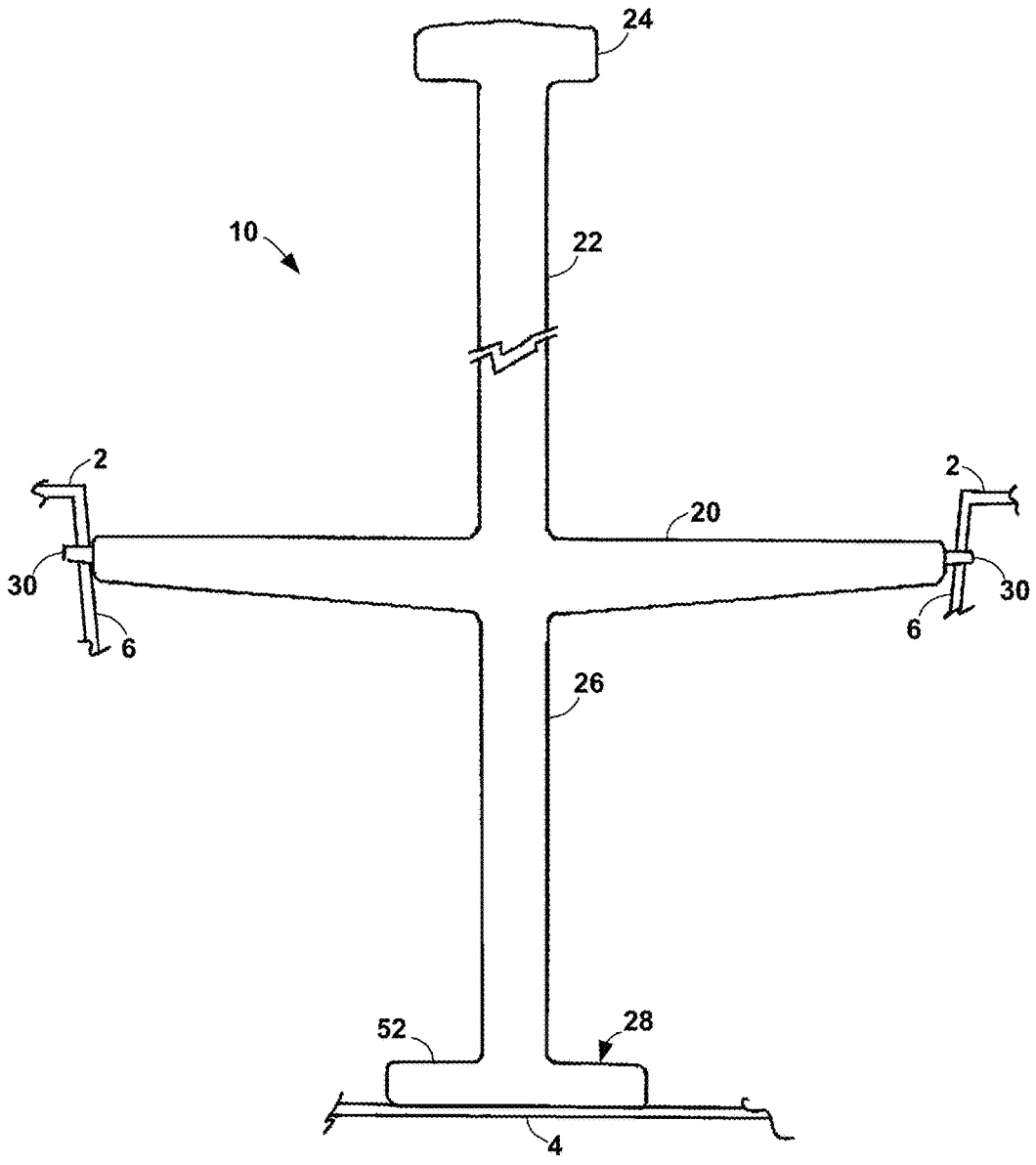
FIG. 2 is a side view of a configuration of the handle with a disk foot.
Figure 3:
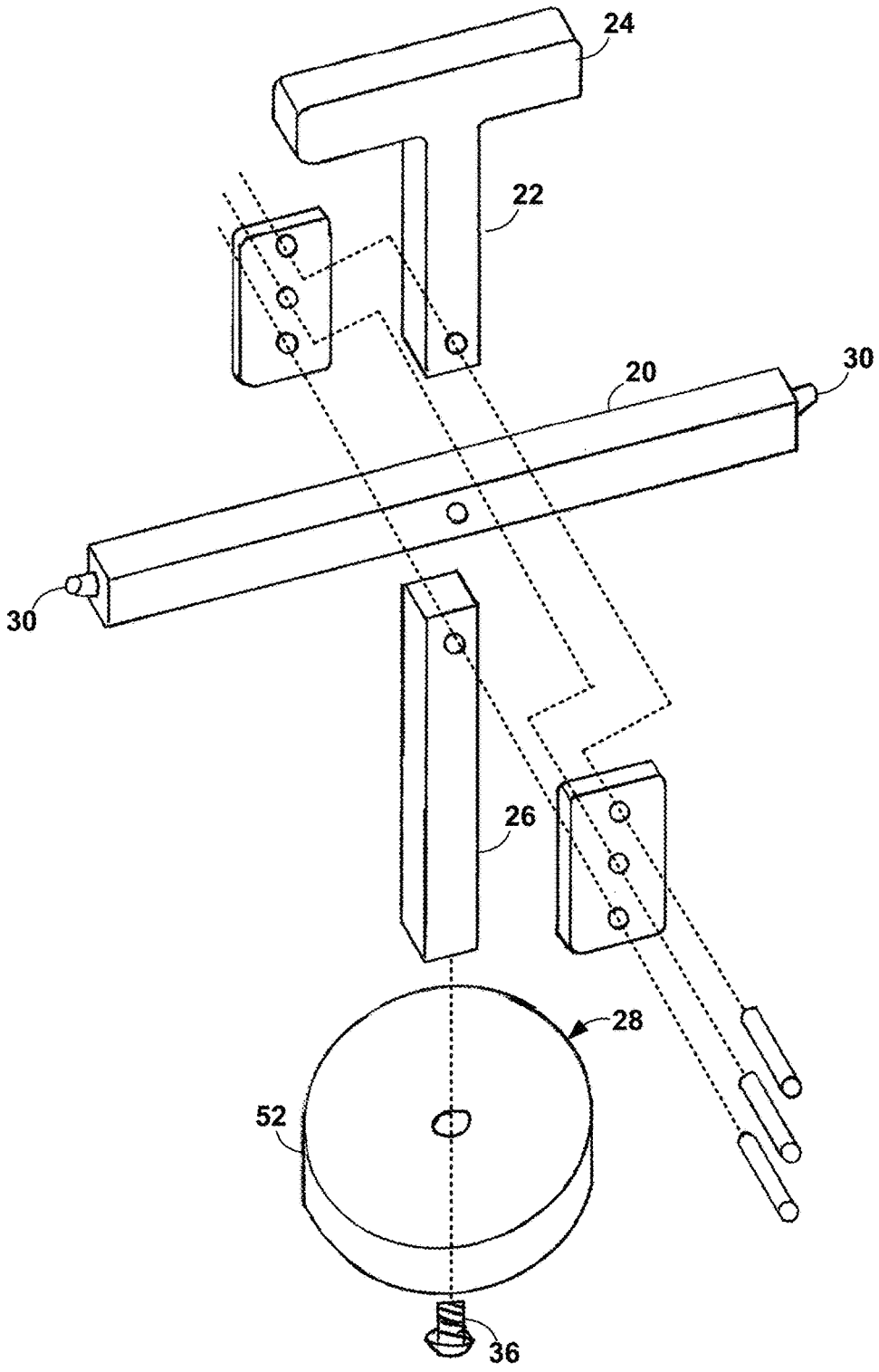
FIG. 3 is an exploded, perspective view of the handle composed of a number of pieces.
Figure 8:
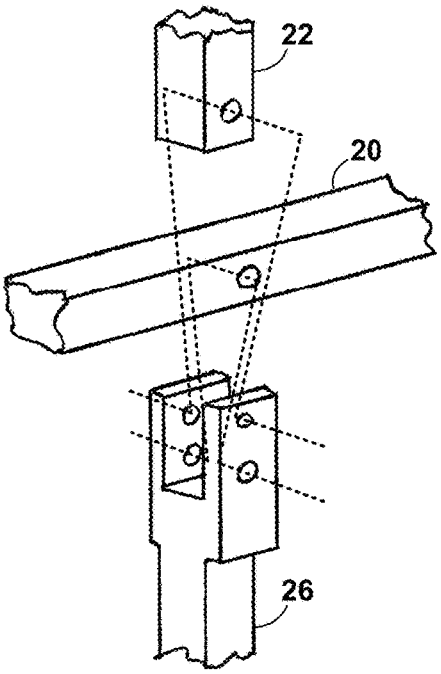
FIG. 8 is an exploded, partial view of an attachment.
Figure 9:
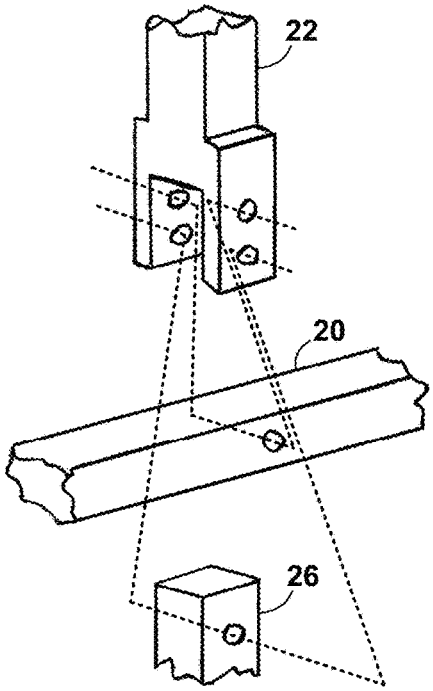
FIG. 9 is an exploded, partial view of another attachment.
Figure 10:
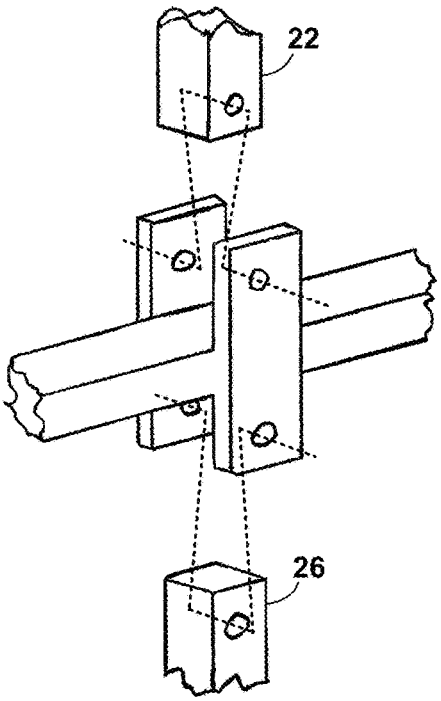
FIG. 10 is an exploded, partial view of another attachment.

The handle 10 of the present invention can be formed as a single piece, as in FIGS. 1 and 2, or can be formed into any number of pieces that are then attached to each other, as in FIG. 3. In the configuration of FIG. 3, the crossbar 20, post 22/grip 24, leg 26, and foot 28 are separate components that are attached together. FIGS. 8-10 show several examples of different ways that the crossbar 20, post 22, and leg 26 can be attached together. The foot 28 is attached to the leg 26 typically by a screw 36, but any other method known in the art can be employed.

Different skimmer baskets have different depths. The present invention contemplates using common molds to manufacture legs of different lengths to accommodate different baskets. As can be seen in FIGS. 4-7, the leg 26 is made relatively short. The foot 28 has a tubular upward extension 40 with an internal stop 42. The cross-sectional shape of the inside of the extension 40 complements the outside shape of the leg 26.

The foot 28 is constructed with the internal stop 42 located in extension 40 at the desired position to suit the distance to the floor 4 of the basket 2. If the foot 28 is molded, a pair of pins or dowels can be inserted into each end of the mold to locate the stop 42 in the desired position in the extension 40. Alternatively, the stop 42 can be a separate component that is positioned at the desired location and glued or otherwise adhered to the extension 40. The leg 26 is inserted into the upper portion 44 of the extension 40 until it abuts the stop 42. Typically a screw 46 is used to attached the foot 28/extension 40 to the leg 26, but any other method known in the art can be employed.

An alternative configuration for accommodating skimmer baskets with different depths is shown in FIGS. 12-16. The leg 26 is made relatively short and has one or more annular grooves 70*a-c* (collectively, 70) in its outer surface 68 that are spaced apart axially from each other. The foot 28 has a tubular upward extension 40. The inner wall 48 of the extension 40 has an internal annular ridge 72 with a cross-sectional shape that complements the cross-sectional shape of the annular grooves 70.

The cross-sectional shape of the inside of the extension 40 complements the outside shape of the leg 26. Optionally, the leg 26 and extension 40 are keyed to prevent them from rotating relative to each other. This is necessary when the foot 28 is a bar 50, like that in FIG. 1, to keep the foot 28 perpendicular to the crossbar 20.

To assemble the handle 10, the leg 26 is inserted into the extension 40 until the ridge 72 snaps into the first groove 70*a*. To make the handle 10 shorter, the leg 26 is pushed farther into the extension until the ridge 72 snaps into the appropriate groove 70. To facilitate assembly, the free end 74 of the leg 26 has an annular bevel 76 so that it can be more easily pushed past the ridge 72.

Figure 13:
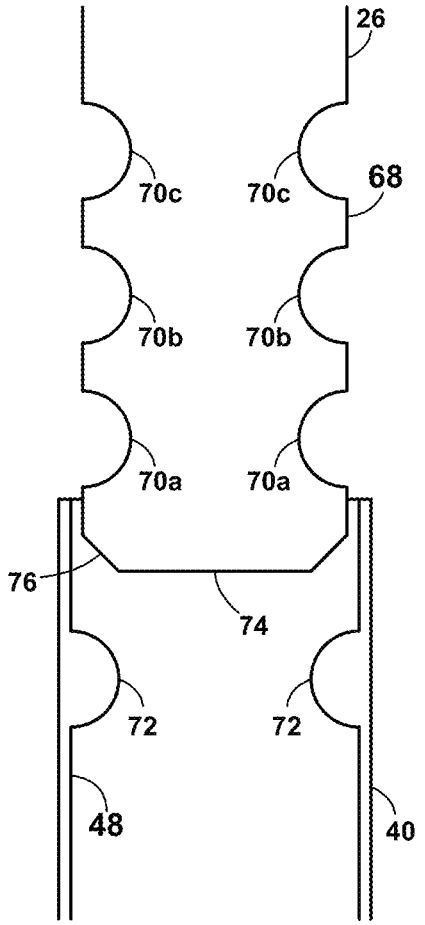
FIG. 13 is a detailed, cross-sectional view of an annular groove/ridge configuration.

Preferably, the grooves 70 and ridge 72 have a generally rounded cross-sectional shape. Most preferably, as shown in FIG. 13, the cross-sectional shape is semicircular. The rounded leading edge 74 of the ridge 72 eases the installation of the leg 26. The complementary cross-sectional shapes of the grooves 70 and ridge 72 help keep the leg 26 from sliding up and down within the extension 40.

Figure 14:
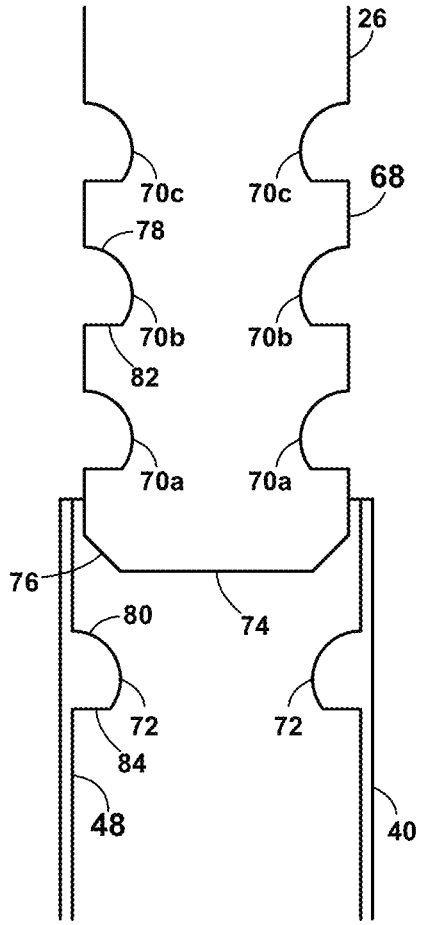
FIG. 14 is a detailed, cross-sectional view of an alternative annular groove/ridge configuration.

An alternative cross-sectional shape for the groove 70 and ridge 72 is shown in FIG. 14. The top section 78, 80 of the groove 70 and ridge 72 is rounded by at least 90° and the bottom sections 82, 84 are radial. The rounded top portions 78, 80 facilitate pushing the leg 26 into the extension 40. After the ridge 72 snaps in the desired groove 70, the two radial bottom portions 82, 84 abut each other to prevent the leg 26 from being pulled from the extension 40.

Figure 15:
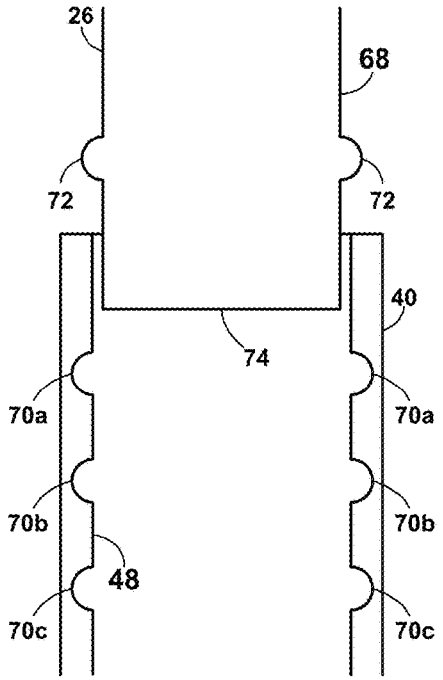
FIG. 15 is a detailed, cross-sectional view of an alternative annular groove/ridge configuration.

Alternatively, there are one or more annular grooves in the extension 40 and an annular ridge on the leg 26, as shown in FIG. 15.

In order for the leg 26 to be pushed into the extension 40, either the extension 40 must be able to temporarily stretch to a larger diameter and then return to its original diameter and/or the leg 26 must be able to temporarily compress to a smaller diameter and then return to its original diameter. Either or both of these can be accomplished by the choice of materials for the extension 40 and leg 26.

Figure 16:
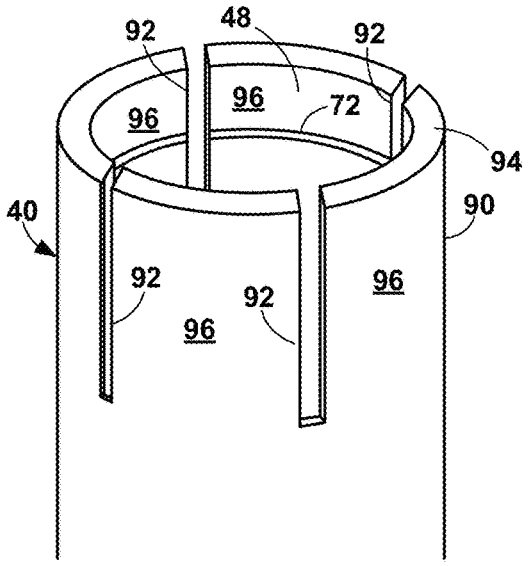
FIG. 16 is a perspective view of an alternate foot extension.

Alternatively, as shown in FIG. 16, the upper portion 90 of the extension 40 has at least two paraxial slits 92 spaced around the circumference of the extension 40. FIG. 16 shows four slits 92. The slits 92 are open at the end 94 of the extension 40, forming wall sections 96 that can flex slightly outwardly. The ridge 72 is positioned in the upper portion 90 of the extension 40 within the length of the slits 92. When the leg 26 is being assembled in the extension 40, as the leg 26 pushes against the ridge 72, the wall sections 96 bend outwardly. When the groove 70 is aligned with the ridge 72, the wall sections 96 straighten back to their original positions with the ridge 72 in the groove 70.

The grooves 70 are spaced apart such that the ridge 72 paired with each groove 70 produces an appropriately-sized handle 10 for a common basket depth. FIGS. 12-15 show three grooves 70, but the present invention contemplates that there can be any number of grooves 70.

To install the handle 10 of the present invention, one knob 30 is inserted into one opening 6, the basket 2 is slightly deformed to elongate the distance between the opposed openings 6, the other knob 30 is aligned with the opposite opening 6, and the basket 2 is allowed to return to its normal shape with the knobs 30 installed in the openings 6 and the foot 28 resting on the basket floor 4.

Thus it has been shown and described a swimming pool skimmer basket handle. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A swimming pool skimmer basket handle comprising:
(a) a horizontal crossbar having two ends;
(b) a knob extending horizontally from each crossbar end;
(c) a post extending upwardly from the crossbar to a grip;
(d) a leg extending downwardly from the crossbar, the leg having a free end, an outer surface, and at least one annular groove in the outer surface;
(e) a foot with a tubular upward extension and an annular ridge within the extension, the annular ridge being complementary to the at least one annular groove, the leg fitting into the extension such that the annular ridge fits into the at least one annular groove and the foot extends horizontally and at least perpendicularly to the crossbar.

2. The swimming pool skimmer basket handle of claim 1 wherein the knob is tapered.

3. The swimming pool skimmer basket handle of claim 1 wherein the foot is a disk.

4. The swimming pool skimmer basket handle of claim 1 wherein the foot has a lip and a hollow interior.

5. The swimming pool skimmer basket handle of claim 4 wherein the foot is an inverted cone.

6. The swimming pool skimmer basket handle of claim 4 wherein the foot is an inverted cup.

7. The swimming pool skimmer basket handle of claim 1 wherein the annular groove and annular ridge are generally semicircular in cross-section.

8. The swimming pool skimmer basket handle of claim 1 wherein the extension has an upper end with a plurality of paraxial slits spaced around the circumference of the extension and wherein the annular ridge is within the length of the slits.

9. The swimming pool skimmer basket handle of claim 1 wherein the free end of the leg has an annular bevel.

10. A swimming pool skimmer basket handle comprising:
(a) a horizontal crossbar having two ends;
(b) a tapered knob extending horizontally from each crossbar end;
(c) a post extending upwardly from the crossbar to a grip;
(d) a leg extending downwardly from the crossbar, the leg having a free end, an outer surface, and at least one annular groove in the outer surface, the at least one annular groove having a semicircular cross-section;
(e) a foot with a tubular upward extension, the extension having an upper end with a plurality of paraxial slits spaced around the circumference of the extension, an annular ridge within the extension and within the length of the slits, the annular ridge having a semicircular cross-section complementary to the at least one annular groove, the leg fitting into the extension such that the annular ridge fits into the at least one annular groove and the foot extends horizontally and at least perpendicularly to the crossbar.

11. The swimming pool skimmer basket handle of claim 10 wherein the foot is a disk.

12. The swimming pool skimmer basket handle of claim 10 wherein the foot has a lip and a hollow interior.

13. The swimming pool skimmer basket handle of claim 12 wherein the foot is an inverted cone.

14. The swimming pool skimmer basket handle of claim 12 wherein the foot is an inverted cup.

15. The swimming pool skimmer basket handle of claim 10 wherein the free end of the leg has an annular bevel.

16. A swimming pool skimmer basket handle comprising:
(a) a horizontal crossbar having two ends;
(b) a knob extending horizontally from each crossbar end;
(c) a post extending upwardly from the crossbar to a grip;
(d) a leg extending downwardly from the crossbar, the leg having a free end, an outer surface, and an annular ridge on the outer surface;
(e) a foot with a tubular upward extension and at least one annular groove in the extension, the at least one annular groove being complementary to the annular ridge, the leg fitting into the extension such that the annular ridge fits into the at least one annular groove and the foot extends horizontally and at least perpendicularly to the crossbar.

17. The swimming pool skimmer basket handle of claim 16 wherein the annular groove and annular ridge are generally semicircular in cross-section.

* * * * *